United States Patent [19]

Fafournoux

[11] Patent Number: 4,576,283

[45] Date of Patent: Mar. 18, 1986

[54] BAG FOR VACUUM PACKAGING OF ARTICLES

[76] Inventor: Bernard Fafournoux, 12ter, route de St-Germain, 78560 Le Port Marly, France

[21] Appl. No.: 573,668

[22] Filed: Jan. 25, 1984

[30] Foreign Application Priority Data

Jan. 25, 1983 [FR] France ..... 83 01077

[51] Int. Cl.[4] ..... B65D 81/20

[52] U.S. Cl. ..... 206/524.8; 383/40

[58] Field of Search ..... 206/524.8, 222; 383/35, 383/38, 40

[56] References Cited

U.S. PATENT DOCUMENTS

| | | | |
|---|---|---|---|
| 2,756,875 | 7/1956 | Yochim | 206/219 |
| 2,778,173 | 1/1957 | Taunton | 206/524.8 |
| 2,870,954 | 1/1959 | Kulesza | 206/524.8 |
| 3,095,291 | 6/1963 | Robbins | 206/219 |
| 3,756,389 | 9/1973 | Firth | 206/219 |
| 3,980,226 | 9/1976 | Franz | 206/524.8 |
| 4,155,453 | 5/1979 | Ono | 150/52 J |

FOREIGN PATENT DOCUMENTS

| | | | |
|---|---|---|---|
| 233987 | 5/1961 | Australia | 383/35 |
| 654570 | 6/1963 | Italy | 206/524.8 |

*Primary Examiner*—Stephen P. Garbe

*Attorney, Agent, or Firm*—Murray, Whisenhunt & Ferguson

[57] ABSTRACT

Within a bag for vacuum packaging of articles there is created, by means of a separately attached sheet, an auxiliary chamber which is evacuated when the bag is manufactured. This chamber may be placed in communication with the interior of the bag, after the latter has been filled and sealed. Such communication is achieved by piercing or tearing the separately attached sheet, so that the residual air in the sealed bag expands into a greater volume in which it is isolated from the product in the bag.

10 Claims, 5 Drawing Figures

BAG FOR VACUUM PACKAGING OF ARTICLES

BACKGROUND OF THE INVENTION

Field of the Invention

The object of the invention is a bag intended for the packaging of various articles, in particular food products, in which there is formed in advance a vacuum reservoir so that the bag may be used without the user requiring to have access to a vacuum machine or apparatus at the time when products to be packaged are placed in the bag.

SUMMARY OF THE INVENTION

The invention consists in a bag for vacuum packaging of articles, comprising flexible walls, a sealable closure, an auxiliary chamber which is evacuated prior to use of the bag, and means for establishing communication between said auxiliary chamber and the interior of the bag after the bag has been closed and sealed.

The invention is not limited to specific ways of implementing the auxiliary chamber or specific means for establishing communication between it and the interior of the bag.

It is preferable, although not mandatory, for the auxiliary chamber to be attached to the inside of the bag, in which case it is advantageous for the chamber to have a wall shared with the bag.

The entire auxiliary chamber, or at least one of its walls, being that which is not shared with the bag, has folding and unfolding means so as to minimise its size when evacuated.

The means for establishing communication between the auxiliary chamber and the interior of the bag may consist in means for piercing the wall of the auxiliary chamber; they may also consist in a rigid member which is easily snapped through the wall of the bag, possibly with a pre-formed break line, forming part of one wall of the auxiliary chamber.

In accordance with the invention, the means for establishing communication between the auxiliary chamber and the interior of the bag may comprise an easily snapped appendix extending away from the wall of the auxiliary chamber, this appendix having an internal volume communicating with the internal volume of the auxiliary chamber. The internal volume of the appendix preferably contains a porous material.

In a first embodiment of the invention, the auxiliary chamber has a first wall which is shared with the bag and a corrugated wall featuring a plane area with an orifice covered by a plate with a pre-formed break line.

In a second embodiment of the invention, the auxiliary chamber is a box of a rigid material having a readily broken off appendix comprising an internal volume filled with porous foam; this box preferably has internal partitions which resist crushing of the box when evacuated and an external surface covered with an adhesive product for attaching it to an internal surface of the bag.

Other objects and advantages will appear from the following description of examples of the invention, when considered in connection with the accompanying drawings, and the novel features will be particularly pointed out in the appended claims.

DESCRIPTION OF THE PREFERRED EMBODIMENTS

Figure 1:
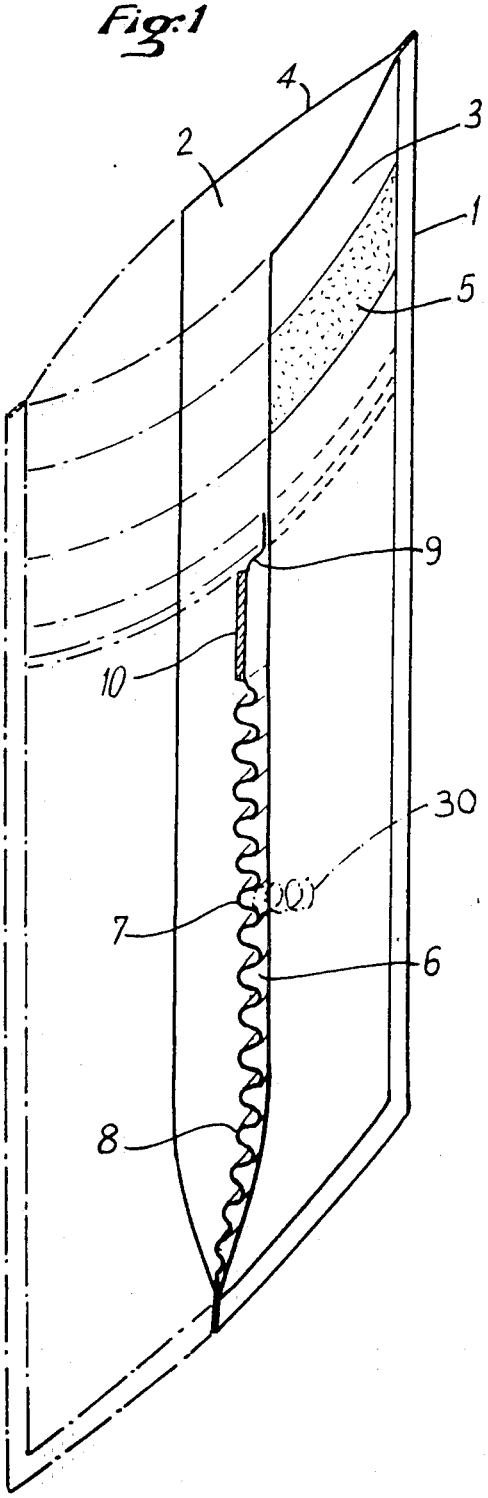
FIG. 1 is a general view in perspective and in cross-section of a bag in accordance with the invention, the missing part being shown in chain-dotted outline.

The bag in FIG. 1 is shown open and sectioned on a longitudinal plane passing through its center, the front part shown in chain-dotted outline having been removed to expose the rear part shown in full line. The bag may be fabricated from any suitable flexible material, either transparent or opaque; for example, it may be fabricated from two sheets 2, 3 of polyethylene welded together along three sides to leave a filling opening 4 at the top. It is adapted to be sealed after filling in a manner known per se, either by heat welding or by means of a transverse strip 5 of adhesive slightly below the top opening 4. The invention is compatible with all types of bag and with all types of sealed closure.

In accordance with the invention, the bag 1 contains an auxiliary chamber 6 which is evacuated at the time of manufacture.

In FIG. 1, the auxiliary chamber 6 is obtained by means of an additional sheet 7 of flexible material welded to the internal surface of one wall 3 of the bag 1. The additional sheet 7 is welded on along its four edges and is preferably folded or corrugated, as by corrugations 8, which prevent the opposite walls of the auxiliary chamber 6 sticking together when the chamber is evacuated, so enabling the chamber to inflate when air enters it.

Folds or corrugations are not always necessary; other means may be utilised to prevent the opposite walls of the auxiliary chamber 6 sticking together whilst also permitting it to be inflated.

In the example of FIG. 1, an area 9 on the additional sheet 7 is smooth; it is employed for the attachment, as by means of an adhesive, for example, of a plate 10 (seen better in FIG. 2) which constitutes means for establishing communication, when required, between the interior of the bag 1 and the evacuated internal volume of the auxiliary chamber 6.

To this end, the additional sheet 7 is pierced by a hole 11 which is covered and closed off by a plane major surface 10A of the plate 10. On the opposite major surface 10B the plate 10 has a transverse groove 12 which makes it easy to snap and which extends over the hole 11. This groove 12 could instead be provided on the major surface 10A over the hole 11, if it did not extend to the opposite edges of the plate 10.

When the bag 1 is manufactured, the chamber 6 is evacuated. After the bag 1 has been filled with a product to be stored in vacuum, it is sealed in the usual manner provided for and then, through the walls 2, 3, the plate 10 is grasped and snapped along the groove 12. The hole 11 then enables the air contained in the bag 1 to enter the auxiliary chamber 6 which inflates. The pressure of the air in the combination of the bag 1 and the auxiliary chamber 6 is correspondingly reduced, becoming significantly less than atmospheric pressure and its value being conditioned by the ratio between the volume of the bag 1, how full it is, the volume of the auxiliary chamber 6 and the intensity of the vacuum formed in the latter at the time of manufacture.

Figure 2:
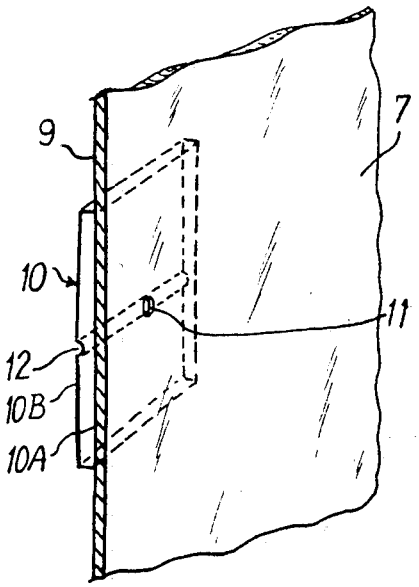
FIG. 2 is a partial view to a larger scale, in perspective and in cross-section, showing means for establishing communication between the auxiliary chamber and the interior of the bag.

It will be noted from FIG. 2 that the plate 10 is attached to the outside surface of the sheet 7 relative to the chamber 6. It could be attached over the hole 11 on the inside surface of the sheet 7, that is to say inside the chamber 6. It would then serve to prevent the opposite walls 7 and 3 of this chamber sticking together.

Figure 4:
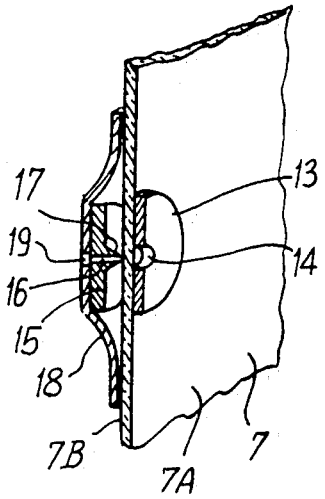
FIG. 4 is a view in perspective and in cross-section of a further form of means for establishing communication between the auxiliary chamber and the interior of the bag.

FIG. 4 shows an alternative embodiment of the means for establishing communication between the auxiliary chamber and the interior of the bag. In this instance, the sheet 7 is not pierced. To its inside surface 7A is attached a first disk 13 formed with a central hole 14. Over the opposite surface 7B a second disk 15 with a central hole 16 and a central pointed protuberance 17 is suspended by means of flexible sheet 18. This is welded around its edge to the sheet 7 and is pierced by a hole 19 opposite the hole 16. The central pointed protuberance 17 is in line with the hole 14 in the first disk 13. When the two disks 13 and 15 are squeezed between the fingers, after the bag has been filled and sealed, the protuberance pierces the sheet 7 and the air can pass through the holes 19, 16 and 14.

In the example described hereinabove, the auxiliary chamber 6 is incorporated in the bag 1, inside the latter, at the time of its manufacture. It will be noted that the auxiliary chamber 6 could be formed outside the bag 1 by attaching the additional sheet 7 to the outside of the wall 3. In this case, it is the latter wall which would be provided with means for establishing communication between the auxiliary chamber and the interior of the bag.

Figure 3:
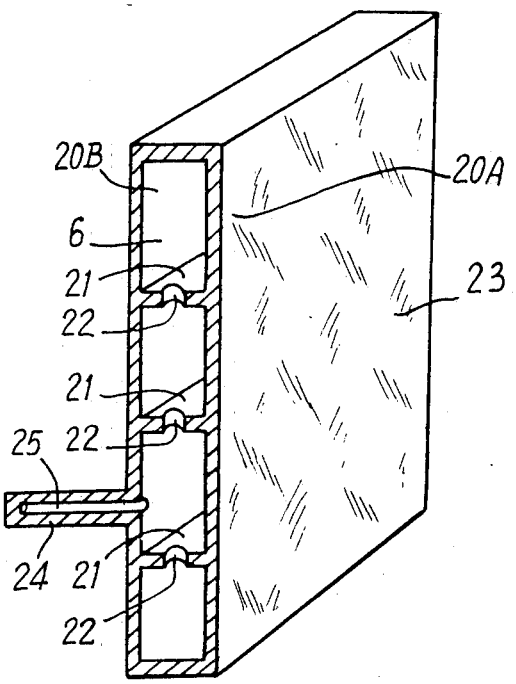
FIG. 3 is a view in perspective and in cross-section of another form of means for establishing communication between the auxiliary chamber and the interior of the bag.

FIG. 3 shows an auxiliary chamber 6 moulded from a rigid material having two opposed main walls 20A, 20B held apart by internal partitions 21 pierced by communicating hole 22, which could be replaced by interruptions across the whole width of the partitions 21, at one end of the latter, for example. The auxiliary chamber is analogous to a box; it is independent of the bag, into which it is inserted when the latter is used; it preferably has one outside surface covered with a film of adhesive material 23 which may be used, if judged necessary, to attach it to an internal surface of the bag 1. The auxiliary chamber in FIG. 3 is formed with an appendix 24 within which is an internal volume 25 which communicates with the internal volume of the chamber 6 but which is isolated from the outside. The appendix 24 is made to be easily broken; it may be formed with predetermined break lines, if required. It is readily snapped through the walls 2, 3 of the bag 1 when the latter has been filled and sealed. The internal volume 25 of the appendix 24 is preferably filled with a porous material allowing air to circulate slowly between the bag 1 and the auxiliary chamber 6.

Figure 5:
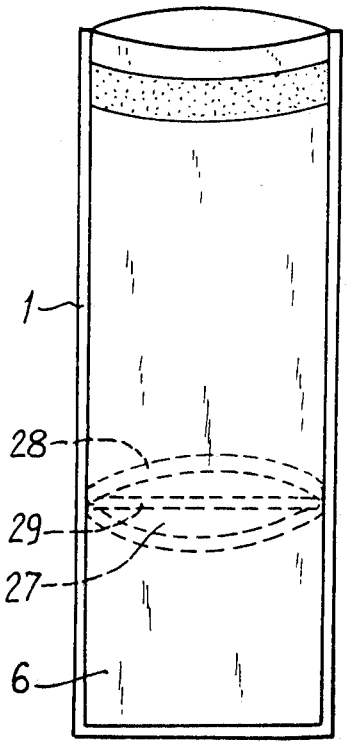
FIG. 5 is a view in perspective of an alternative embodiment of a bag in accordance with the invention.

FIG. 5 shows a bag 1 in which the auxiliary chamber 6 is formed by a transverse partition 27 which has a raised edge 28 by means of which it is welded to the inside surface of the bag 1, after the latter is fabricated. This partition 27 has a weakened central area 29 so that it can be torn by pulling on either side of this area 29 through the walls of the bag 1 after it is filled and sealed.

The auxiliary chamber 6 in accordance with the invention may be evacuated by any means available.

The air may be drawn out by means of an air pump. When the auxiliary chamber 6 has rigid walls, as in the example shown in FIG. 3, it retains its shape. After the bag 1 is filled with the products to be stored, as soon as the auxiliary chamber 6 is placed in communication with the bag 1, the residual air necessarily expands into the chamber 6.

If the auxiliary chamber 6 does not have totally rigid walls, it flattens when it is evacuated. It is desirable to provide it with elastic means adapted to make it resume its initial shape after evacuation, and either before or after establishment of communication between the auxiliary chamber 6 and the interior of the bag 1. FIG. 5 relates to a bag and auxiliary chamber of which the walls are of a semi-rigid and elastic material and tend to retain or resume their initial shape after evacuation.

It is interesting to note that when the auxiliary chamber 6 is provided with elastic means, it may be evacuated without using an air pump. All that is required is to flatten the chamber and then hermetically seal it. When it then resumes its initial shape, it will be evacuated.

The necessary elasticity may be conferred on the auxiliary chamber 6 by giving it semi-rigid and elastic walls capable of resuming their initial shape after crushing. If the walls are not of themselves capable of resuming their initial shape, an internal spring may be provided tending to urge apart the walls; an internal spring 30 is shown in chain-dotted lines in FIG. 1. This spring 30 is held in position by guide means (not shown).

Consequently, the elastic means are incorporated into the walls of the auxiliary chamber 6 or attached to this chamber as elastic separation means.

It will be noted that the volume of the auxiliary chamber 6 filled with air need not be of considerable size. If the bag 1 to be filled has a volume V, after filling, it contains only a volume v of residual air, which may be very small. If the auxiliary chamber 6 filled with air has a volume of 10v and is virtually totally evacuated, when it is placed in communication with the volume v of residual air, the pressure in the bag 1 becomes one tenth of atmospheric pressure. The larger proportion of the residual air is then in the auxiliary chamber 6. In all cases the means for establishing communication between the auxiliary chamber and the interior of the bag are of very small cross-section, in particular when an appendix 24 is used with its internal volume 25 filled with porous material. As a result, the larger proportion of the residual air is trapped in the auxiliary chamber and isolated from the product contained in the bag. The latter is thus usable by anyone anywhere without access to a vacuum machine.

It will be understood that various changes in the details, materials and arrangements of parts, which have been herein described and illustrated in order to explain the nature of the invention, may be made by those skilled in the art within the principle and scope of the invention as expressed in the appended claims.

I claim:

1. A bag for vacuum packaging of articles, said bag comprising:

flexible walls;

a sealable closure, said flexible walls and sealable closure defining an interior of said bag for receiving articles;

an auxiliary chamber;

a wall common to said interior and said auxiliary chamber, said auxiliary chamber being evacuated at the time of the manufacture of the bag;

communicating means for establishing communication through said wall common to said interior of said bag and said auxiliary chamber to permit residual air in said interior to flow into said auxiliary chamber after said bag has been filled, closed and sealed.

2. A bag according to claim 1, wherein said auxiliary chamber is incorporated into said bag, and said auxiliary chamber is delimited by said wall common to said interior and said auxiliary chamber and by a separate sheet attached internally of the bag.

3. A bag according to claim 2, wherein said separate sheet is folded or corrugated.

4. A bag according to claim 2, wherein said communicating means is constituted by said separate sheet having a weakened area, said weakened area being easily torn to establish communication through said wall between said interior of the bag and said auxiliary chamber.

5. A bag according to claim 2, wherein said communicating means comprises a hole in said separate sheet and a plate covering said hole, said plate being formed with a groove in line with said hole so that said plate is easily snapped.

6. A bag according to claim 2, wherein said communicating means comprises a member having a pointed protuberance for piercing said separate sheet.

7. A bag according to claim 6, wherein said member is disposed on one side of said separate sheet in face-to-face relationship with an opposed member formed with a hole and disposed on the opposite side of said separate sheet.

8. A bag according to claim 1, wherein said auxiliary chamber is a rigid box having an appendix which is readily broken off, said appendix comprising an internal volume which communicates with the interior of said auxiliary chamber.

9. A bag according to claim 1, wherein said auxiliary chamber is provided with elastic means for causing said auxiliary chamber to return to an original shape after evacuation.

10. A bag for vacuum packaging of articles, said bag comprising:

flexible walls;

a sealable closure, said flexible walls and sealable closure defining an interior of said bag for receiving said articles;

an auxiliary chamber incorporated into said bag, said auxiliary chamber being delimited by a wall common to said auxiliary chamber and said interior and by a separate sheet attached internally of said bag, said auxiliary chamber being evacuated at the time of manufacture of the bag;

communicating means for establishing communication through said wall common to said interior of said bag and said auxiliary chamber, said communicating means comprising a hole in said separate sheet and a plate covering said hole, said plate being formed with a groove in line with said hole so that said plate is easily snapped.

* * * * *